US005600361A

United States Patent [19]

Dirx

[11] Patent Number: 5,600,361

[45] Date of Patent: Feb. 4, 1997

[54] STORAGE BOX FOR A CASSETTE FOR A THERMAL PRINTER

[75] Inventor: Lieven Dirx, Oud-Turnhout, Belgium

[73] Assignee: Agfa-Gevaert N.V., Mortsel, Belgium

[21] Appl. No.: 410,988

[22] Filed: Mar. 27, 1995

[30] Foreign Application Priority Data

Apr. 29, 1994 [EP] European Pat. Off. ..... 94201180

[51] Int. Cl.[6] ..... B41J 2/01; B41J 32/00

[52] U.S. Cl. ..... 347/214; 206/394; 206/393

[58] Field of Search ..... 400/692, 693, 400/693.1, 207; 206/393, 394; 347/214

[56] References Cited

U.S. PATENT DOCUMENTS 5,415,486 5/1995 Wouters et al. ..... 400/692

5,547,298 8/1996 Wouters et al. ..... 400/692

*Primary Examiner*—Huan H. Tran

*Attorney, Agent, or Firm*—Brumbaugh, Graves, Donohue & Raymond

[57] ABSTRACT

A storage box (10, 12) for a dye ribbon cassette (33) which is provided with a laterally outwardly extending handle (28, 29) at each lateral side allowing easy gripping of the cassette, said storage box being a generally rectangular enclosure having a top, bottom, two side walls and a rear wall, a front opening (18) giving access to the box and a door (19) for closing such opening, and a slot (22) in each side wall extending up from the front end of the box in the direction of the rear wall, the height and the configuration of said slots being such as to allow insertion of a cassette in the storage box through its front opening while the handles fit in said slots, the outside portion of the handles remaining outside of the box thereby allowing gripping of the cassette.

9 Claims, 3 Drawing Sheets

STORAGE BOX FOR A CASSETTE FOR A THERMAL PRINTER

BACKGROUND OF THE INVENTION

1. Field of the Invention

The present invention relates to a storage box for a cassette for use with a thermal printer.

2. Description of the Prior Art

In a thermal printing process, a dye-bearing donor ribbon is brought into contact with a dye-receiving print sheet at a print zone. Thermal printing is effected by contacting the donor ribbon with a multi-element print head which spans the ribbon in a direction transverse to the direction of ribbon travel. The print head typically comprises a linear array of closely spaced resistive heating elements, each being individually addressable by an applied voltage to heat that portion of the donor ribbon directly opposite and thereby cause dye to be transferred from the ribbon to the print sheet. The print sheet is attached to the surface of a rotatable print drum which advances the print sheet past the print head.

The dye ribbon is in the form of a web-like dye carrier containing a series of spaced frames of different coloured heat-transferable dyes and is spooled on a supply spool. The ribbon is paid out from the supply spool and rewound on a take-up spool. The dye ribbon is difficult to handle since it has typically a thickness in the order of magnitude of ten micrometers only in order not to impede the heat transfer from the heating elements towards the receiver sheet. For that reason, the supply spool and the take-up spool are usually provided in a dedicated cassette which has a central rectangular opening allowing the print head to urge the ribbon in contact with the receiver sheet on the print drum.

The first types of cassettes were made of plastic and were of the disposable type. The convenience for the operator of the printer was high and protection of the vulnerable ribbon was satisfactory.

Environmental requirements put an ever increasing strain on the use of disposable cassettes and so there came of a second type of cassettes which were reloadable and basically had the same configuration as the original disposable ones, but which had a two-part construction allowing their opening and reloading. Supply of a full and a take-up spool occurred in a simple cardboard package.

Then came a third type of cassette which is not a duplication of former plastic ones but which up from the beginning was designed as a reloadable cassette. It is a sturdy, completely open structure and in fact is nothing else than a frame, comprising basically two parallel flanges of sheet metal and interconnecting rods, between which a supply and a take-up spool are rotatably and removably supported. The frame has at its lateral sides handles for its manipulation. Such manipulation is delicate, considering the kind of ribbon loaded in the completely open frame structure. A cassette of the described type is disclosed in our co-pending EP Appl. 92 203 247.9, filed 22 Oct. 1992 and entitled: "Dye ribbon package for use with a thermal printer and a method of loading the reloadable cassette of a thermal printer with a dye ribbon from a dye ribbon package" which corresponds to U.S. Pat. No. 5,415,486.

Yet this cassette does not completely solve the manipulation problem of a dye ribbon for the following reason. Thermal printing is used for producing transparent as well as opaque prints, and this in black-and-white or in colours. These different types of applications require corresponding types of dye ribbons and thus in practice at least three cassettes are used each loaded with a suitable dye ribbon. In use of a printer, an operator can be forced to regularly replace a cassette by another one depending on the type of work being done. Whereas frequent handling of a cassette as such does not raise a problem because of the handles provided, storage of the cassettes does form a point since the spools with dye ribbon are freely exposed and thus accidental touching or soiling by dust can intolerably damage the ribbon.

SUMMARY OF THE INVENTION

Object of the Invention

It is the object of the present invention to provide a storage box for a cassette of the type described, which allows an easy and safe keeping of a loaded cassette during periods of non-use, i.e. while not in place in the printer.

Statement of the Invention

In accordance with the present invention, a storage box for a cassette for use with a thermal printer, which cassette is arranged for receiving a supply spool with a roll of dye ribbon wound thereon and a take-up spool having the leading end of the dye ribbon attached thereto for receiving the ribbon as it is paid off from the supply spool, said cassette being provided with a laterally outwardly extending handle at each lateral side allowing easy gripping of the cassette, is characterised thereby that it is a generally rectangular enclosure having a top, bottom, two side walls and a rear wall, a front opening giving access to the box and a door for closing such opening, and a slot in each side wall extending up from the front opening of the box in the direction of the rear wall, the height and the configuration of said slots being such as to allow insertion of a cassette in the storage box through its front opening, the outside portion of the handles remaining outside of the box thus allowing manipulation of the cassette.

The inventive storage box affords a satisfactory protection of a cassette loaded with a dye ribbon against environmental conditions. It has been shown that the openings in the housing of the storage box, namely the two slots in the side walls, are not of a nature to cause problems with the dye ribbon. It should be recalled that the main purpose of the storage box is not to form an air- and moisture-tight barrier for the dye ribbon as does the original wrapping in which a fresh supply and take-up spool are packed, but rather to protect the dye ribbon after its first use in the printer against finger and other contacts.

Other advantages of the inventive storage box are as follows. The box is space saving. First, because the front door gives direct access to the box so that removal of a cassette can occur without having to take off and put down a top cover or the like or pull out a slide as in many other storage holders. Second, because several boxes can be stacked onto each other, while still permitting their individual use.

Further, the storage box is time saving because of the direct access via the front door. Removal of a cassette requires thereby a few manipulations only so that there is a saving in time and risc which is important such as in emergency cases in the medical field.

The level of the slots in the lateral walls of the storage box can be such that the handles extend freely through the slots, without contact with their opposed walls, the cassette being supported on the bottom wall of the box.

However, it is suitable to have the slots in the storage box at a level such that the cassette is freely suspended in the box, the handles being supported by the slots. This has the advantage that the tolerances on the height of the slots with respect to the bottom of the box and the corresponding height of the handles on the frame is less critical. Furthermore, it is avoided that the flanges of the cassette in the long run cause grooves in the inside surface of the bottom after repeated insertion and withdrawal of cassettes.

Other preferred features of a storage box in accordance with the invention are as follows.

The depth of the supporting slots is less than 80% of the depth of the box.

The handles are flat in the direction of the slots and the height of the slots is such that, taking account of the width and the thickness of the handles, tilting of the handles and thus of the cassettes cannot occur to such an extent that a cassette would touch either the bottom or the top wall of the box.

The door of the box has a hinge at its lower end whereby a swung-down door provides unhindered access to the box.

The storage box has a handle that can be pulled out to facilitate transport of the box.

The storage box is arranged for stacking with other boxes to constitute a multi-cassette holder.

BRIEF DESCRIPTION OF THE DRAWINGS

The invention will be described hereinafter by way of example with reference to the accompanying drawings wherein.

DETAILED DESCRIPTION OF THE INVENTION

Figure 1:
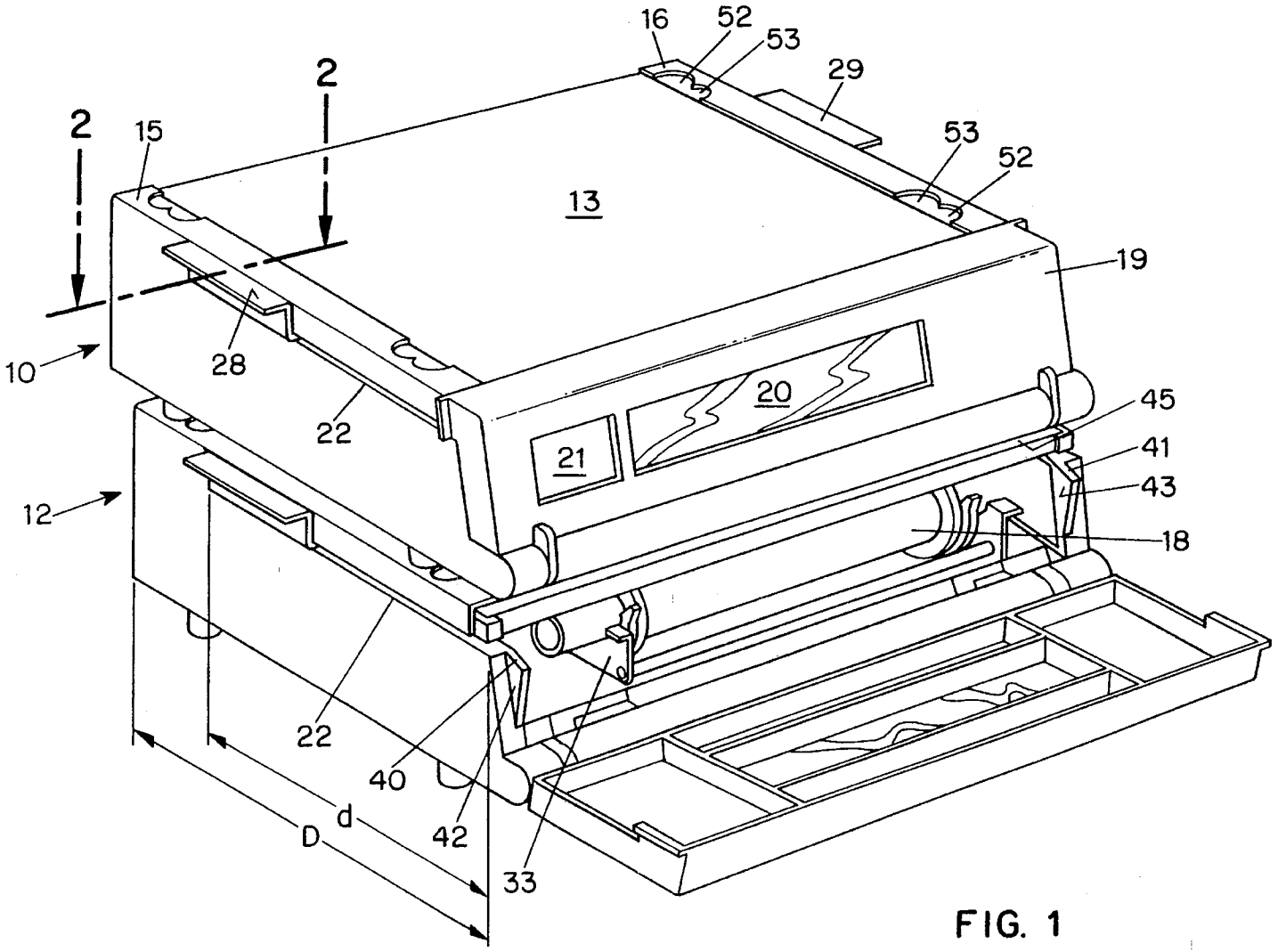
FIG. 1 is a perspective view showing one embodiment of an assembly of two storage boxes in accordance with the invention.

The drawing of FIG. 1 shows one embodiment of a storage box according to the invention. Two storage boxes 10 and 12 are shown stacked onto each other, the lower one being opened to show a stored cassette.

Referring to upper storage box 10, the box is generally a rectangular housing having a top wall 13, a bottom wall 14 (see FIG. 4), two side walls 15 and 16, a rear wall 17 and a front opening 18 (see lower box 12) closeable by a door 19 hingeably connected at its lower end to the housing. Door 19 has a glass panel 20 allowing inspection of the inside of the box and a recess 21 for a label identifying the contents of the box.

Figure 2:
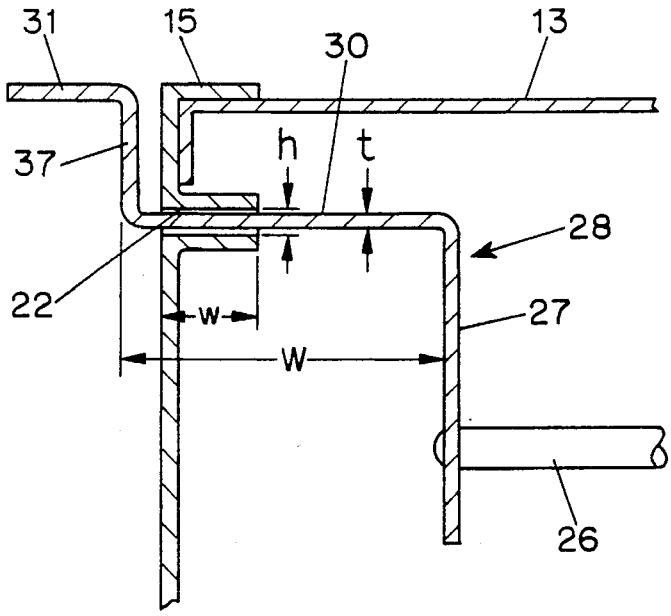
FIG. 2 is a vertical section on line 2—2 of a portion of one side wall of the storage box of FIG. 1.

Each of side walls 15 and 16 is provided with a slotlike opening 22 which extends up from the front opening and runs parallel to the bottom over a depth d which is less than depth D of the box (see box 12). Suitably d is smaller than 0.75 D. The width w of the slots is less than the width W of the inner portion 30 of a handle of a cassette to be stored (see FIG. 2). The slots have a height h slightly larger than the thickness t of the handles.

Figure 3:
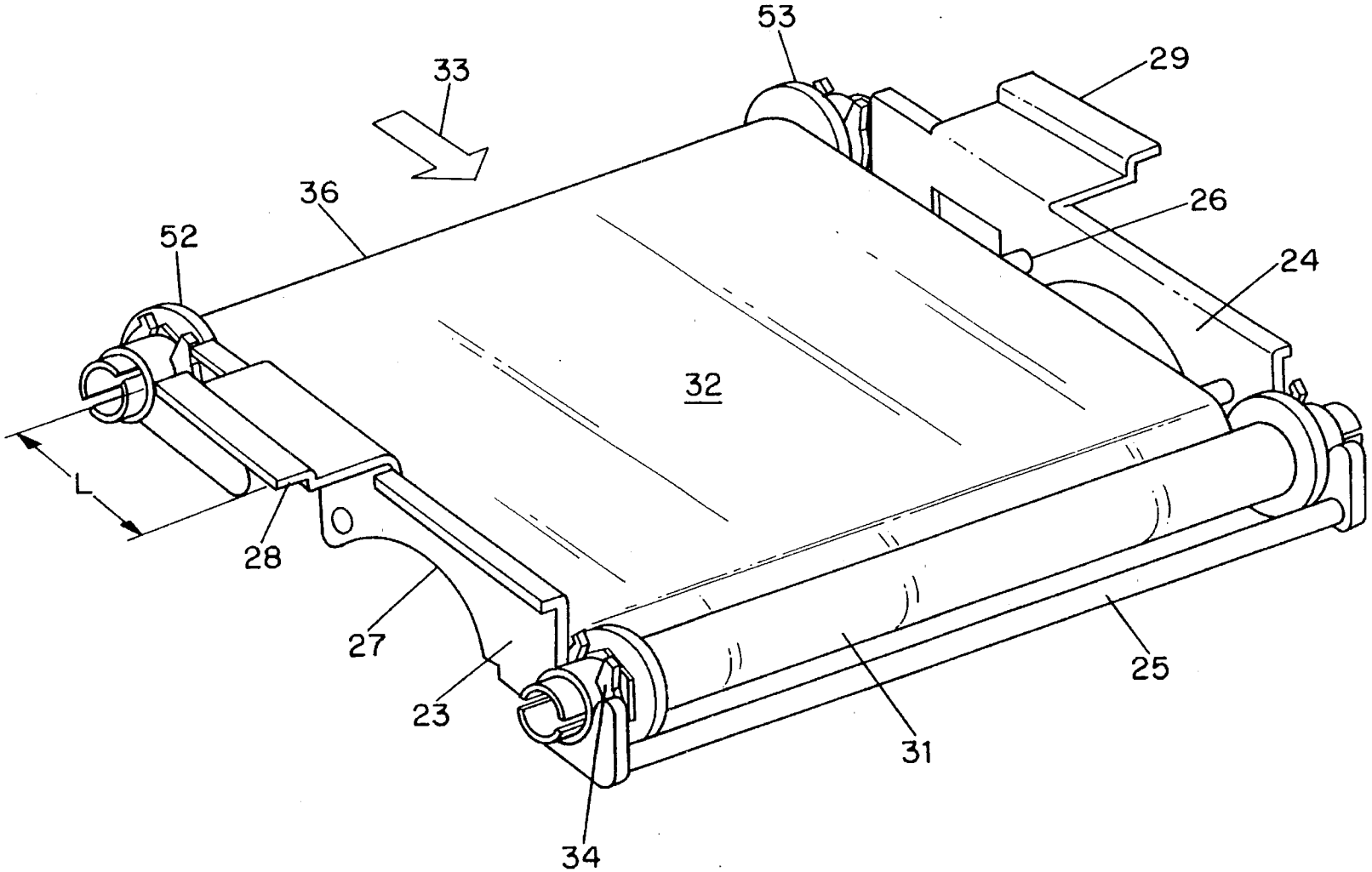
FIG. 3 is a perspective view of one embodiment of a cassette for use in the box of FIG. 1.

One embodiment of a dye ribbon cassette for use with a storage box according to the invention is shown in FIG. 3. The cassette 33 basically is a metal frame composed of two flanges 23 and 24 held in spaced parallel relationship by several interconnecting rods such as 25 and 26. The flanges have at their lower side a concave opening 27 for properly fitting over the print drum of a thermal printer. At their upper side the flanges have handles 28 and 29 with a stepped form, comprising an inner portion 30, a central one 37 and an outer one 31 as shown in detail for handle 28 in FIG. 2. The handles are preferably integral with the flanges, and a suitable construction material is stainless steel foil properly cut and angled.

A supply spool 31 with a roll of dye ribbon 32 wound thereon fits in spring clips of the frame, such as 34, whereas a winding spool 36 is similarly journalled at the opposite end of the frame. The described frame is a sturdy and yet light-weight construction that is easily manipulated by means of its two handles, the operator's fingers engaging the outer portions 31 of the handles and being held well remote thereby of the ribbon by central portions 37.

Insertion of a cassette in an opened box occurs by carefully locating the winding spool end of the frame in the box while seeking contact of the inner portions 30 of handles 28 and 29 with upper surfaces 40 and 41 of shoulders 42 and 43 at the entry opening 18 of the box. Surfaces 40 and 41 are slightly slanting and guide a handle in contact therewith upwardly until it precisely fits in a corresponding groove 22. Flanges 52 and 53 on winding spool 36 avoid any contact of the spool core with the walls of the cassette.

Further insertion of the cassette causes the handles to become aligned horizontally by contact with the opposed walls of slots 22 so that the cassette moves parallel with the bottom and top wall of the box until the handles are stopped by contact with the rear end of slots 22.

The level of the slots 22 above bottom wall 14 is such that the cassette is freely suspended in the box by means of its handles. The height h of the slots and the thickness t and length L (see FIG. 3) of the handles are such that possible tilting of a cassette is very limited so that a loaded cassette will neither touch the bottom nor the top wall of the box. Lateral positioning of a cassette in the box is obtained by central portions 37 of the handles engaging the outside surface of one or the other of lateral walls 15, 16 of the box.

The following example illustrates the storage box and a dye-ribbon cassette for use therewith, described hereinbefore.

| | |
|---|---|
| General size of the box | 380 × 90 × 275 mm |
| Wall depth D | 255 mm |
| Slot depth d | 192 mm |
| Slot height h | 2.5 mm |
| Slot width w | 15.0 mm |
| Handle thickness t | 1.5 mm |
| Handle length L | 65 mm |
| Handle depth W | 45 mm |
| Dye ribbon length | 60 m |
| width | 270 mm |

Figure 4:
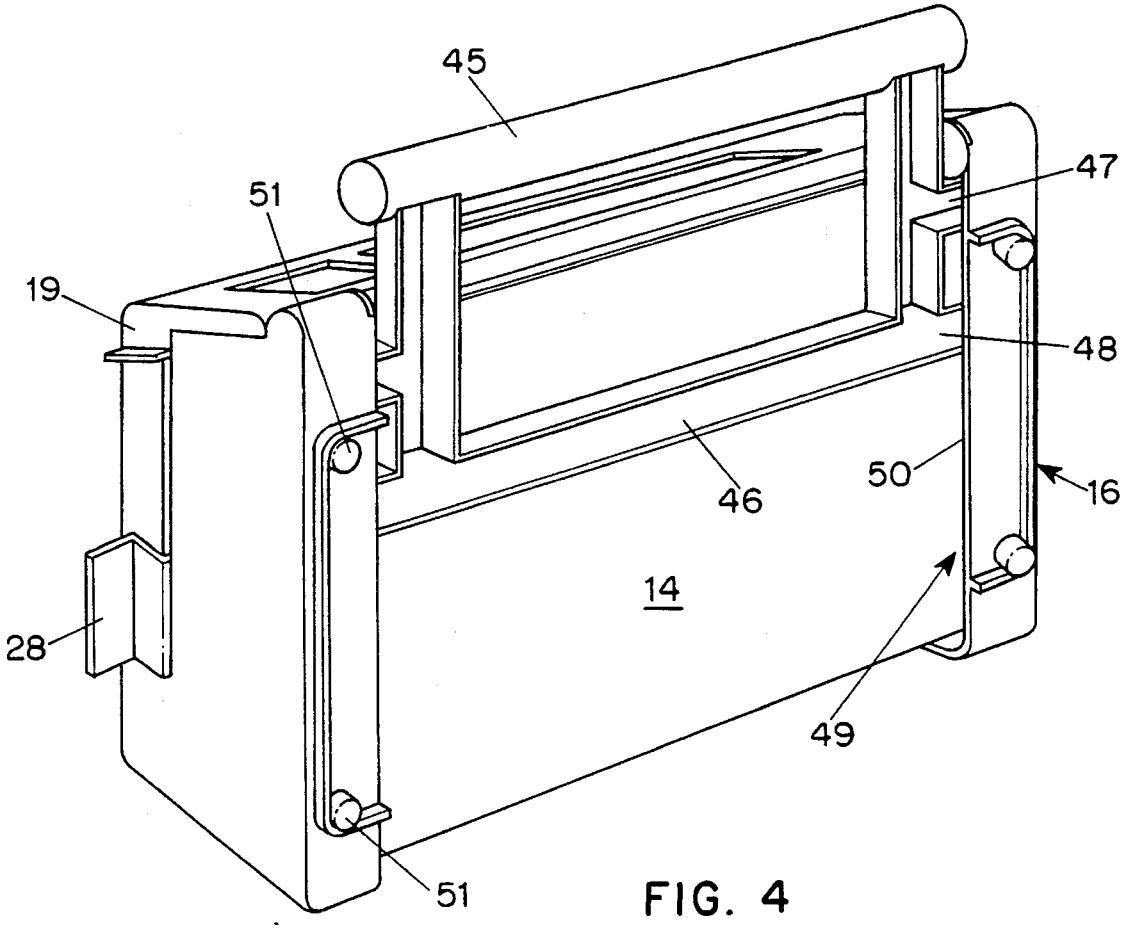
FIG. 4 is a perspective view of the storage box according to FIG. 1, resting on its rear wall and seen from the bottom.

According to a suitable embodiment of the invention, a storage box as shown can be provided with a handle 45, which facilitates transport of a box. Such handle can make part of a frame 46 as shown in FIG. 4, which has four outwardly extending legs, such as 47 and 48 shown for one side, sliding in a groove such as 49 formed by bottom wall 14 of the box and a lower rim 50 of lateral wall 16. FIG. 4 shows handle 45 in the box-carrying position, whereas FIG. 1 shows the handle in its withdrawn position.

According to a further suitable embodiment of the invention, a storage box has four feet 51 that can fit in four corresponding recesses on top of the box, recesses 52 being located more rearwardly and recesses 53 being located more forwardly. Recesses 52 allow storage boxes to be stacked while staggered rearwardly with respect to each other as shown in FIG. 1 so that the slightly inclined doors lie flush with each other. However, feet 51 can also fit in more forward recesses 53 so that the boxes are truely vertically stacked and their rear walls lie flush with each other.

A storage box according to the invention can be made of any suitable material. In the box described hereinbefore, the side panels and the door were made by injection moulding of a suitable plastic, e.g. ABS, whereas the top, rear and bottom wall were formed by appropriate cutting and folding of a plate which fitted in corresponding recesses and grooves of the side panels.

The handles of a dye ribbon cassette for use with a storage box according to the invention can have other shapes than the one shown in the figures, and so does the cassette itself. More details about a cassette that can be used with the inventive storage box, and a technique of adequate loading with a fresh roll of dye-ribbon can be found in our co-pending EP application mentioned hereinbefore.

It is clear that the stiffness of the construction of the storage box should be such that occasional stacking of three or more boxes does not cause any reduction of the slot height h of the lower box to an extent that the handles of a cassette therein would become blocked.

I claim:

1. A storage box (10, 12) for a cassette (33) for use with a thermal printer, which cassette is arranged for receiving a supply spool with a roll of dye ribbon wound thereon and a take-up spool having the leading end of the dye ribbon attached thereto for receiving the ribbon as it is paid off from the supply spool, said cassette being provided with a laterally outwardly extending handle (28, 29) at both lateral sides allowing easy gripping of the cassette, characterised in that said storage box is a generally rectangular enclosure having a top (13), bottom (14), two side walls (15, 11) and a rear wall (17), a front opening (18) giving access to the box and a door (19) for closing such opening, and a slot (22) in both side walls extending up from the front opening of the box in the direction of the rear wall, the height and the configuration of said slots being such as to allow insertion of a cassette in the storage box through its front opening while the handles fit in said slots, the outside portion (31) of the handles (28, 29) remaining outside of the box thus allowing manipulation of the cassette.

2. A storage box according to claim 1, wherein the inside portion (30) of the handles (28, 29) is supported by the slots (22).

3. A storage box according to claim 2, wherein said supporting slots (22) extend parallel to the bottom wall of the box.

4. A storage box according to claim 1, wherein the depth d of said supporting slots (22) is less than 75% of the depth D of the box.

5. A storage box according to claim 1, which has slanting guide surfaces (40, 41) near its front opening (18) facilitating access of the handles of a cassette to said slots (22).

6. A storage box according to claim 1, wherein the handles (28, 29) are flat in the direction of the slots, and the height h of the slots is such that, taking account of the length L and the thickness t of the handles, tilting of the handles and thus of the cassettes cannot occur to such an extent that a cassette would touch either the bottom or the top wall of the box.

7. A storage box according to claim 1, wherein the door (19) of the box has a hinge (9) at its lower end.

8. A storage box according to claim 7, in which the door (19) has a slightly inclined position to the vertical.

9. A storage box according to claim 8, which has feet (51) and two series (52, 53) of corresponding recesses on its topside allowing a truly vertical or a slightly rearwardly staggered stacking of several boxes to constitute a multicassette holder.

* * * * *